US007681426B2

(12) United States Patent
Main et al.

(10) Patent No.: US 7,681,426 B2
(45) Date of Patent: Mar. 23, 2010

(54) UNITARY REAR AXLE HOUSING AND METHOD FOR MANUFACTURING SAME

(75) Inventors: James Main, Tillsonburg (CA); John Bulic, Woodstock (CA)

(73) Assignee: ArcelorMittal Tubular Products Canada Inc., Hamilton (CA)

( * ) Notice: Subject to any disclaimer, the term of this patent is extended or adjusted under 35 U.S.C. 154(b) by 533 days.

(21) Appl. No.: 11/510,196

(22) Filed: Aug. 25, 2006

(65) Prior Publication Data

US 2007/0062241 A1 Mar. 22, 2007

Related U.S. Application Data

(60) Provisional application No. 60/711,270, filed on Aug. 26, 2005.

(51) Int. Cl.
*B21C 1/24* (2006.01)
*B21C 3/06* (2006.01)
*B21C 37/30* (2006.01)

(52) U.S. Cl. ..... 72/283; 72/276; 72/370.01; 72/370.15; 72/370.25

(58) Field of Classification Search ..... 72/276, 72/283, 367.1, 368, 370.01, 370.14, 370.15, 72/370.23, 370.24, 370.25
See application file for complete search history.

(56) References Cited

U.S. PATENT DOCUMENTS

| | | | | |
|---|---|---|---|---|
| 3,837,205 | A | 9/1974 | Simon | |
| 4,435,972 | A | 3/1984 | Simon | |
| 4,616,500 | A * | 10/1986 | Alexoff | 72/283 |
| 5,303,985 | A | 4/1994 | Barnholt et al. | |
| 6,279,695 | B1 | 8/2001 | Davison | |
| 2004/0060385 | A1 | 4/2004 | Prucher | |

* cited by examiner

*Primary Examiner*—Dana Ross
*Assistant Examiner*—Mohammad Yusuf
(74) *Attorney, Agent, or Firm*—IpHorgan Ltd.

(57) ABSTRACT

A method for manufacturing a one piece axle tube housing with an integral spindle includes providing a tube blank, providing the blank with a region of increased thickness, inserting a mandrel having a reduced diameter profile, passing a reducing die over the tube to conform the tube to the shape of the mandrel; and extraction of the mandrel from the tube to cause outward deformation of the tube at specific locations. A further swaging step may be used to form the final spindle structure.

11 Claims, 3 Drawing Sheets

UNITARY REAR AXLE HOUSING AND METHOD FOR MANUFACTURING SAME

CROSS REFERENCE TO PRIOR APPLICATIONS

This application claims the benefit of U.S. Provisional Application Ser. No. 60/711,270, filed Aug. 26, 2005, the entire contents of which are incorporated herein by reference.

FIELD OF THE INVENTION

The present invention relates to axle housings and more specifically to a one-piece axle housing incorporating an axle tube and spindle. The invention also provides a method of manufacturing such axle housings.

DESCRIPTION OF THE PRIOR ART

Axle assemblies are well known in the art. Typically, such housings include an axle tube (which encloses the axle shaft), a spindle located at the terminal ends of the axle tube (for engaging the wheel or bearing parts), and other components such as brake flanges or spiders, spring seats, shock absorber pads etc. Generally, all of the aforementioned parts are formed separately and subsequently welded together to form the axle housing. However, the various forming and welding steps are time and labour intensive.

As is known in the art, axle spindles generally require a larger wall thickness than the axle tube due to the increased strength demands of such sections. As such, it is common for the spindles to be forged separately and subsequently attached (by such means as friction welding) to the axle tube. Examples of such a two step method are taught in U.S. Pat. Nos. 3,837,205 and 6,279,695. However, as indicated above, the requirement for welding increases the cost of the final article. Moreover, due to the high temperatures generated and required by the known welding methods, the strength of the metal surrounding the welded regions are known to be reduced.

In U.S. Pat. No. 5,303,985, a method is taught of forming a one piece axle housing by means of casting. However, although such methods avoid the need for welding sections together, the use of a common wall thickness over the entire length of the housing greatly increases the weight of the article. Moreover, the forging process results in a metal having inferior strength characteristics thereby necessitating the need for a thicker walled, and therefore heavier, housing.

U.S. Pat. No. 4,435,972 teaches a multi-step method for forming an axle housing wherein a series of mandrels is used to form the required cross sectional profile. Thus, this method involves a large cycle time. Further, this method is limited to forming tubes made of malleable steel having high formability characteristics and could not be used to form heavy duty axles housings.

A further method is taught in US application published under number 2004/0060385. This method results in a one-piece axle housing tube incorporating a spindle. However, the method taught in this reference requires multiple dies and, therefore, longer cycle times.

Thus, there exists a need for an improved axle housing and method for making same that overcomes at least some of the deficiencies of the prior art.

SUMMARY OF THE INVENTION

In one aspect, the present invention provides an axle housing wherein the axle tube and the spindle are formed as a unitary structure.

In another aspect, the invention provides a method of forming an axle housing wherein the axle tube and the spindle are formed as a unitary structure.

In another aspect, the invention provided a method of forming a one-piece axle housing with an integral spindle, the method comprising:

a) providing a tubular blank having an inner surface with a uniform first inner diameter, an outer surface with a uniform first outer diameter, and a uniform first wall thickness;

b) increasing the wall thickness of a region of said blank, said region being located proximal to a first end of said blank and corresponding to the location of the spindle;

c) providing a mandrel within said tubular blank, said mandrel having a cross sectional profile including a first reduced diameter portion at a first end of said mandrel, said first end being provided within said blank at a location corresponding to said region of increased wall thickness;

d) applying a radially inward force on said blank to force the inner surface of said blank to conform to said mandrel cross sectional profile while providing a reduced uniform second outer diameter on said blank, wherein, during application of said radially inward force, said region of increased thickness is forced into said reduced diameter end portion of said mandrel;

e) separating said mandrel from said tubular blank.

In another aspect, the present invention provides a method for manufacturing a tubular article having a desired cross sectional profile including regions of increased wall thickness, the method comprising:

a) providing a tubular blank having an inner surface with a uniform first inner diameter, an outer surface with a uniform first outer diameter, and a uniform first wall thickness;

b) increasing the wall thickness of a region of the blank while maintaining the first outer diameter at the region;

c) providing a mandrel within the tubular blank, the mandrel having a cross sectional profile complementary to the desired cross sectional profile;

d) applying a radially inward force on the blank to force the inner surface of the blank to conform to the mandrel cross sectional profile and wherein the tubular blank is provided with a reduced, uniform second outer diameter;

e) separating the mandrel and the tubular blank whereby the blank outer surface is expanded to the desired cross sectional profile.

In another aspect, the present invention provides a method for manufacturing a tubular article having a desired cross sectional profile including regions of increased wall thickness, the method comprising:

a) providing a tubular blank having an inner surface with a uniform first inner diameter, an outer surface with a uniform first outer diameter, and a uniform first wall thickness;

b) increasing the wall thickness of a region of said blank;

c) providing a mandrel within said tubular blank, said mandrel having a cross sectional profile complementary to said desired cross sectional profile;

d) applying a radially inward force on said blank to force the inner surface of said blank to conform to said mandrel cross sectional profile and wherein said tubular blank is provided with a reduced, uniform second outer diameter;

e) separating said mandrel from said tubular blank.

In another aspect, the present invention provides a method of forming a one-piece axle housing with an integral spindle, the method comprising:

a) providing a tubular blank having an inner surface with a uniform first inner diameter, an outer surface with a uniform first outer diameter, and a uniform first wall thickness;

b) increasing the wall thickness of a region of the blank while maintaining the uniform first outer diameter at the region, the region being located proximal to a first end of the blank and corresponding to the location of the spindle;

c) providing a mandrel within the tubular blank, the mandrel having a cross sectional profile including a first reduced diameter portion at a first end of the mandrel, the first end being provided within the blank at a location corresponding to the region of increased wall thickness;

d) applying a radially inward force on the blank to force the inner surface of the blank to conform to the mandrel cross sectional profile while providing a reduced uniform second outer diameter on the blank, wherein, during application of the radially inward force, the region of increased thickness is forced into the reduced diameter end portion of the mandrel;

e) separating the mandrel and the tubular blank whereby the blank outer surface is expanded to the desired cross sectional profile.

In yet another aspect, the invention provide a one-piece tubular articles, such as an axle housing tube having a desired cross-sectional profile including sections of differing outer diameters and differing wall thicknesses.

BRIEF DESCRIPTION OF THE DRAWINGS

These and other features of the invention will become more apparent in the following detailed description in which reference is made to the appended drawings wherein.

DESCRIPTION OF THE INVENTION

Figure 1:
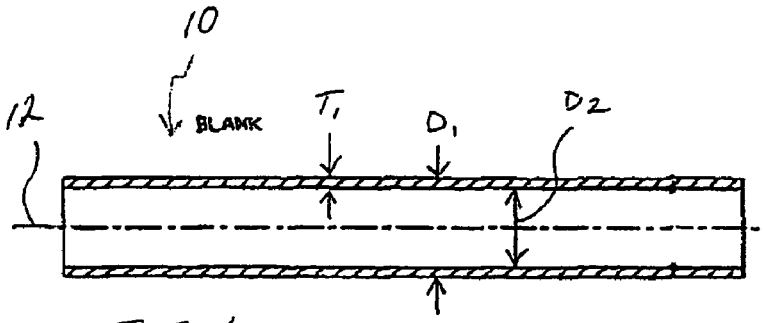
FIG. 1 is a cross sectional view of a tube blank to be used in the method of the invention.

FIG. 1 illustrates a tube blank from which the desired axle housing is formed. As shown, the tube blank 10 comprises a cylindrical tube having an initial outer diameter D1 and an initial wall thickness T1, both of which are generally constant along the length of the tube's longitudinal axis 12. This results in the tube 10 having a generally constant inner diameter D2. The outer diameter D1 of the tube is less than the outer diameter of the desired final product, as will become clear in the following description.

Figure 2:
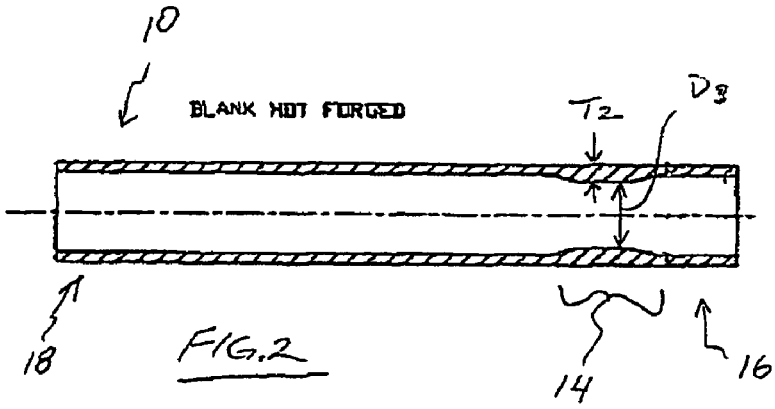
FIG. 2 is a cross sectional view of the tube following the localized thickening step.

As illustrated in FIG. 2, the first step of the method of the invention involves providing a thickened region, or localized area, 14 having an increased wall thickness T2. Such region 14 is provided on a first end 16 of the tube blank 10 and generally corresponds to the location of the spindle to be formed (which is described further below). The opposite, second end 18 of the tube blank 10 is not thickened in this manner. The thickening of the region 14 can be achieved using a variety of known methods as will be apparent to persons skilled in the art. In one aspect, the invention involves heating the region 14 and hot forging the blank 10 at the region 14 to obtain the required thickening. The heating of the tube blank 10 can be accomplished in a variety of known manners such as with an induction heating element, a flame, an oven or other such apparatus. In one aspect, an induction heating element is used since it provides an efficient means of obtaining the required discrete heating zone. The region 14 is heated until the reduction in yield strength (caused by the heating) renders the region 14 sufficiently malleable. The amount of heat required and the final temperature of the region 14 will be known to persons skilled in the art and will depend on various factors such as the composition of the tube, the thickness of the tube, the ambient temperature etc.

Once the region 14 is sufficiently heated, the blank 10 is subjected to a forming operation whereby the wall thickness at the region 14 is increased. In one aspect of the invention, the forming operation comprises a forging step wherein one end of the blank 10 is held in position and a compressive force (such as from a hammer mill etc.) is applied to the opposite end. It will be appreciated that any known forming operation can be used in the present invention for achieving the desired result. Due to the reduction in yield strength at the region 14, it will be understood that the region 14 will undergo a deformation. As illustrated in FIG. 2, the forging step is conducted so as to increase the wall thickness of the region 14 to a thickness T2. In one aspect, this increase in wall thickness is obtained while maintaining the outer diameter D1 constant. In another aspect, the outer diameter D1 may be reduced during the thickening step depending upon the amount of wall thickening required by using an outer diameter (OD) die during application of the compressive force. It will be appreciated that various other forming operation for achieving this result will be known to persons skilled in the art. As will be understood, the inner diameter at the region 14 will, therefore, have a reduced inner diameter D3, which is less than the inner diameter D2 of the remainder of the blank 10. It will also be understood that, as shown in FIG. 2, the wall thickness of the region 14 will generally taper from the thickness T2 to the thickness T1 at each end of the region 14. This type of transition will be known to persons skilled in the art as a common feature in forging operations.

Figure 3:
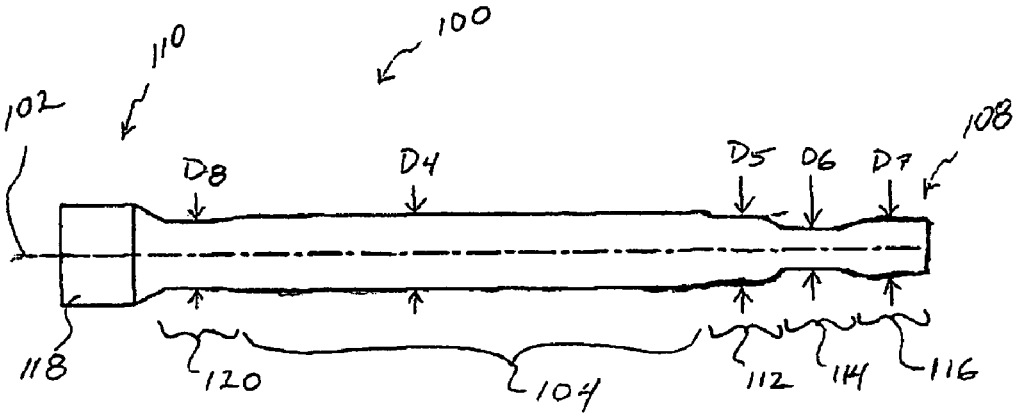
FIG. 3 is a cross sectional view of the mandrel used in the method.

The next step of the method of the invention involves the insertion of a cold forming mandrel into the tube blank 10. The mandrel used for this step is illustrated in FIG. 3. As shown, the mandrel 100 is, one aspect, generally cylindrically shaped having a central axis 102 and a main body 104 of a generally constant outer diameter D4. It will be understood that the mandrel 100 is shaped and sized to permit insertion into a tube blank 10. The outer diameter D4 of the mandrel main body generally corresponds to the inner diameter D2 of the tube 10, however, as will be understood by persons skilled in the art, diameter D4 may be slightly less than diameter D2 in order to permit the mandrel to be inserted into the tube blank 10.

In one aspect of the invention, the mandrel 100 includes a first end 108 and an opposite second end 110. First end 108 of the mandrel has a complementary shape corresponding to the spindle end 16 of the tube 10. The first end 108 of the mandrel 100 includes various sections indicated as 112, 114 and 116, each having differing outer diameters D5, D6, and D7, respectively, wherein D5>D7>D6. Each of diameters D5, D6 and D7 are, in turn, less than the outer diameter D4 of the mandrel main body 104. It will be understood that, as shown in FIG. 3, the transitions between the diameters of each of sections 104, 112, 114, and 116 may be gradual.

The second end 110 of the mandrel 100 is generally provided with a clamping portion 118 to which can be attached an arm or clamp (not shown) for moving the mandrel within the tube 10 (as discussed further below). In one embodiment, the second end 110 of the mandrel 100 is also provided with a reduced diameter section 120 having an outer diameter D8 that is less than diameter D4. The purpose of sections 112, 114, 116, and 120 will become apparent in the following description of the invention. It will also be understood by persons skilled in the art that the specific design and geometry of the mandrel 100 shown and described herein serves to form the axle housing from a tube blank as herein described. Therefore, it will be apparent to persons skilled in the art that where the method of the invention is to be used for forming any other tubular article, the mandrel used for the method will have a respective shape depending on the shape of the article being formed.

Figure 4:
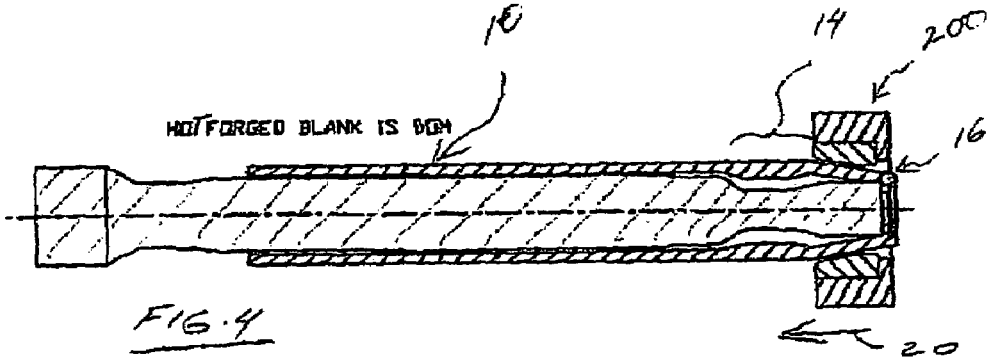
FIG. 4 is a cross sectional view of the tube following-insertion of the mandrel.

As indicated above, the next step in the method of the invention comprises the insertion of the mandrel 100 into the tube blank and this is illustrated in FIG. 4. In this step, the mandrel 100 is inserted into the tube blank 10 of FIG. 2 by inserting the first end 108 of the mandrel into the second end 18 of the tube blank. As indicated above, the outer diameters D4 to D7 are sized so as to be slidably received within the inner diameter D2 of the main body of the tube bank 10. The mandrel 100 is then advanced until the first end 108 of the mandrel reached the first end 16 of the tube 10. As shown in FIG. 4, the section 114 of the mandrel 100 corresponds in position to the region 14 of the tube blank 10. It will also be noted that the outer diameter D3 of the thickened region 14 generally corresponds to the outer diameter D7 of section 116 of the mandrel 100. Thus, during insertion of the mandrel 100 into the tube blank 10, the blank is not materially deformed.

In a preferred embodiment, the first end 16 of the tube is crimped or "nosed", so as to reduce the outer diameter thereof, prior to insertion of the mandrel 100. Such "nosing" serves to limit the advancement of the mandrel 100 and prevent same from extending beyond the desired position.

Further, as known in the art, it is often preferred for the tube to be lubricated to facilitate passage of the mandrel.

In the above description, the mandrel is indicated as being advanced through the tube 10. However, it will be understood that it is also possible for the mandrel 100 to remain stationary and for the tube to be advanced there-over. Similarly, it is possible for both the tube and the mandrel to be advanced together.

Once the mandrel 100 is advanced to the desired position within the tube 10, a die 200, such as a reducing die, is mounted over the first end 16 of the tube 10 and advanced in a direction shown by arrow 20 over the length of the tube 10. It will be understood, and known in the art, that during insertion of the die 200 over the first end 16 of the tube 10, and passage of the die over the length of the tube, the second end 18 of the tube will be anchored so as to prevent movement of same.

Figure 5:
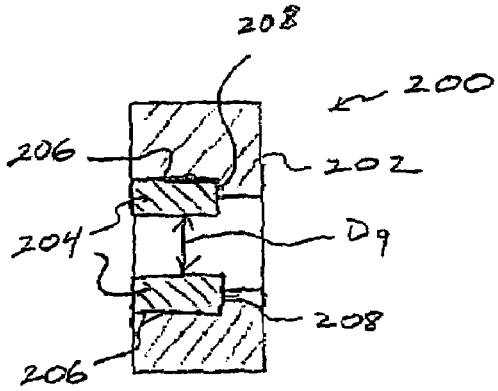
FIG. 5 is a cross sectional view of a die of the invention.

An embodiment of the die according to the present invention is shown in FIG. 5. As shown, the die 200 comprises a generally annular shaped body having two sections: a support ring 202 and a generally annular forming ring 204. The support ring 202 may, as known in the art, include a recess 206 to receive the forming ring 204 and, preferably a shoulder 208 to maintain the forming ring in position. The forming ring includes an inner diameter D9, which corresponds with the outer diameter of the final desired article and which is generally less than the outer diameter D1 of the tube blank 10. It will be understood that various other configurations of the die 200 are known in the art and can equally be used in the present invention.

Figure 6:
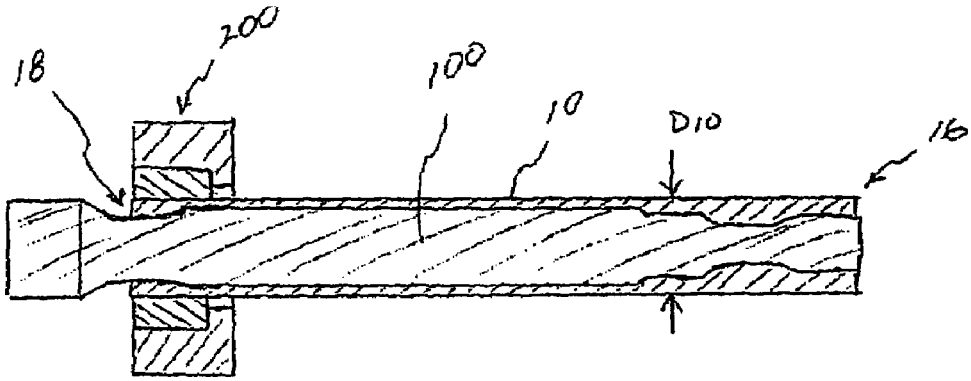
FIG. 6 is a cross sectional view of the tube and mandrel complex, following passage of the die.

As indicated above, the die 200 is provided over the first end 16 of the tube having the mandrel 100 contained within. The die is then forcibly moved over the outer surface of the tube blank 10 in a direction towards the second end 18 of the blank. The terminal position of the die 200, after traversing the length of the tube 10, is shown in FIG. 6. As can be seen, the passage of the die 200 over the tube 10 forces the tube inner diameter to conform to the outer shape of the mandrel 100. That is, after the die 200 is passed over the tube 10, the inner wall of the tube 10 will include mirror images of the sections 112, 114, and 116 of the mandrel. Furthermore, since, as indicated above, the inner diameter D9 of the forming ring 204 of the die 200 is less than the outer diameter D1 of the tube blank 10, the tube outer diameter will be reduced during passage of the die. As can be seen in FIG. 6, once the die 200 is passed over the tube 10, the tube is provided with a generally uniform outer diameter D10, which generally corresponds to diameter D9. However, since the outer diameter D4 of the mandrel 100 is generally the same as the inner diameter D2 of the tube, it will be appreciated that, during passage of the die 200, the wall thickness of the tube blank 10, over the section 104 of the mandrel, will be reduced. Such reduction in wall thickness will result in an accumulation of tube material ahead of the die 200 as it is passed towards end 18 of the tube. In the result, such accumulated material will concentrated within the space created by the reduced diameter (D8) section 120 of the mandrel. Thus, the inner wall of the second end 18 of the tube 10 will generally assume the shape of the outer surface of section 120 of the mandrel 100.

In the above description, the die 200 is described as being advanced over the tube 10. However, it will be understood that it is also equally possible for the die to remain stationary and for the tube to be inserted there-through. Similarly, it is possible for both the tube and the die to be advanced together.

Once the die 200 is passed over the length of the tube 10, the die is removed. Subsequently, with the tube 10 retained in position, the mandrel is withdrawn from the tube 10. Alternatively, it will be understood that the tube can be stripped from the mandrel. As will be understood by persons skilled in the art, the withdrawal of the mandrel 100 is accomplished by means of a clamp (not shown) grasping, for example, the end 118 of the mandrel and applying a pulling force thereon. Such clamp can also be used to maintain the mandrel in position while the tube is withdrawn. It will also be understood that as the mandrel 100 (or tube 10) is withdrawn from the position shown in FIG. 6, the outer diameter of the tube 10 will deformed as the larger sections of the mandrel pass through narrower inner diameter sections of the tube 10. For example, as the mandrel section 104 is pulled through the second end 18 of the tube, the thickened section at such end will be forced radially outwards. Similarly, as the mandrel section 116 is drawn through the thickened tube section which had corresponded to mandrel section 114, the outer diameter of the tube in such section will also be forced radially outwards. However, this will be dependent upon product design requirements. For example, in one aspect of the invention, the mandrel can be withdrawn without radial expansion of the tube. In such case, the mandrel at section 116 can be altered to suit different product designs. For example, if the diameter D7 of section 116 of the mandrel is the same or less than the diameter D6 at section 114, then it will be understood that a radial expansion of the tube will not occur when the mandrel is withdrawn.

Figure 7:
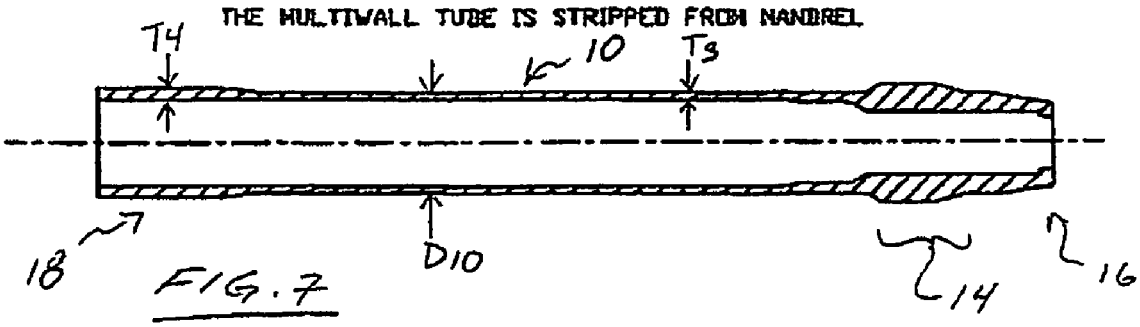
FIG. 7 is a cross sectional view of the tube after withdrawal of the mandrel.

The cross section of the tube 10, following complete withdrawal of the mandrel, is shown in FIG. 7. The thickened region 14 is also clearly observed. As described above, the main body of the tube 10 is provided with a reduced wall thickness T3, which is thinner than the initial thickness T1. Further, as also described above, the tube 10 is also provided with an increased wall thickness T4 at the second end 18.

Figure 8:
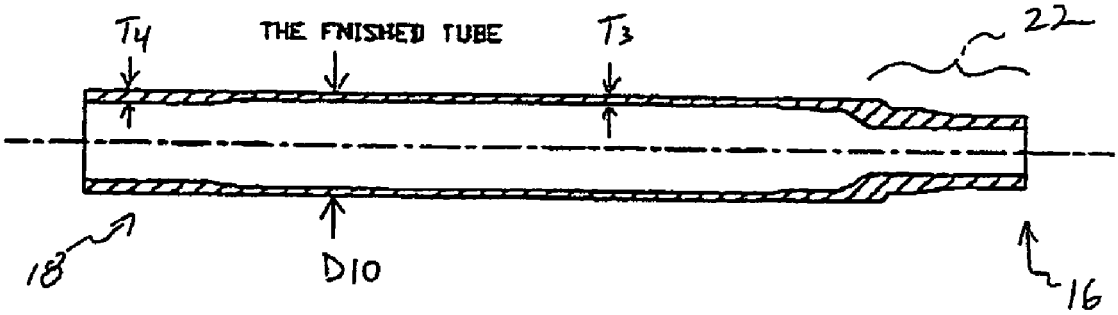
FIG. 8 is a cross sectional view of the tube after swaging.

Following separation of the mandrel 100 and the tube 10, the resulting tube (i.e. as shown in FIG. 7) can then be swaged or otherwise treated or formed at the first end 16 to arrive at the final shape shown in FIG. 8. The final profile provided on the tube 10 results in the first end 16 having the shape and structural features of a spindle 22. As also shown in FIG. 8, in a preferred embodiment, the second end 18 of the tube 10 can also be swaged so as to provide the second end 18 with the same outer diameter D10 as the body of the tube.

As will be appreciated by persons skilled in the art, the second end 18 of the tube is attached to the differential of an automobile. As such, the increased thickness provided at the second end 18 serves to provide the tube with increased strength at the point of such attachment. Similarly, the tube can be provided with other regions of strength (i.e. increased wall thickness) as needed.

As will be appreciated, the method of the present invention provides an axle housing tube that incorporates, as a unitary body, the required spindle. The method avoids the need for multiple welding steps as well as the possible deleterious effects resulting from the welding process such as structural weakening. Further, the method of the present invention permits the formation of a unitary tube having specifically localized regions of increased thickness for providing stiffness in areas subject to high stresses. In addition, by providing a method involving mainly the cold forming of the tubular blank, it will be understood that production costs will be lower with the invention (due to reduced energy demands by avoiding hot forging). Further, by using only a single mandrel and reducing die, the cycle time for producing tubular articles with the present invention is also greatly reduced. In the result, it will be appreciated that the present invention provides an efficient and cost effective method for producing tubular articles having various cross sectional profiles.

Although the present invention has been illustrated by means of referring to the manufacture of an axle housing, it will be appreciated that the present method can be used for manufacturing various types of tubular articles. Further, although the terms diameter, radius etc. have been used with reference to cylindrical articles, it will be understood that the invention is not limited to cylindrical or straight articles alone. In addition, even where the method is used to provide a generally cylindrical article, such article can, of course, be further formed into various shapes.

Although the invention has been described with reference to certain specific embodiments, various modifications thereof will be apparent to those skilled in the art without departing from the spirit and scope of the invention as outlined in the claims appended hereto.

We claim:

1. A method of forming a one-piece axle housing with an integral spindle, the spindle having a spindle cross sectional profile, the method comprising:

a) providing a tubular blank having a first end and a second end and an inner surface with a uniform first inner diameter, an outer surface with a uniform first outer diameter, D1, and a uniform first wall thickness;

b) providing a mandrel having a first end, a second end, a main body portion between the first and second ends, and a longitudinal cross sectional profile wherein:

the mandrel main body has a generally constant outer diameter D4; and the mandrel first end comprises at least two reduced outer diameter sections, comprising a first reduced diameter, D6, section proximal to the first end and a second reduced diameter, D7, section located between the first reduced diameter D6 section and the first end;

wherein diameters D6 and D7 are less than diameter D4; and wherein diameter D6 is less than diameter D7;

c) increasing the wall thickness of a region of said blank, said region being located proximal to the first end of said blank;

d) positioning the mandrel within the tubular blank to form a blank and mandrel combination, wherein the first end of the mandrel is positioned near the first end of the tubular blank and wherein the region of increased wall thickness of the blank is provided over section D6 of the mandrel;

e) passing the blank and mandrel combination through a die having a die opening, said die opening having a diameter D9, which is greater than diameter D4 of the mandrel body and less than the outer diameter D1 of the blank, to force the inner surface of said blank radially inwards to conform to said mandrel cross sectional profile while providing a reduced uniform second outer diameter on said blank, wherein, said region of increased thickness of said blank is forced into section D6 of said mandrel;

f) separating said mandrel from said tubular blank by drawing the mandrel through the second end of the blank; and g) forming the first end of the tube blank to provide said spindle cross sectional profile.

2. The method of claim 1 wherein step (c) comprises increasing the wall thickness of the region of said blank while maintaining said uniform first outer diameter.

3. The method of claim 1 wherein step (c) comprises: (i) subjecting said region to a localized heating; and, (ii) subjecting said tube to an axially compressive force to cause deformation of the tube at said region.

4. The method of claim 1 wherein step (g) comprises swaging said tube blank first end to reduce the outer and inner diameters thereof.

5. An axle housing manufactured according to the method of claim 4.

6. The method of claim 1 further comprising forming the second end of said tube blank to provide a desired cross sectional profile, wherein:

the mandrel of step (b) includes at least one reduced outer diameter, D8, section proximal to but spaced from the mandrel second end and wherein said diameter D8 is less than the diameter D4; and step (e) comprises accumulating material constituting the tube blank within the section D8 of the mandrel, thereby providing said tube blank second end with an increased wall thickness.

7. The method of claim of 6 further comprising forming the tube blank second end to reduce the outer and inner diameters thereof.

8. The method of claim 7 wherein said forming comprises swaging said tube blank second end.

9. An axle housing manufactured according to the method of claim 8.

10. The method of claim 1 wherein:

the mandrel of step (a) further includes a third reduced outer diameter section D5 located between the first reduced diameter section D6 and the main body, the diameter D5 being greater than diameter D6 and less than diameter D7; and wherein step (e) further comprises forcing a portion of the inner wall of the tube blank to conform to section D5 of the mandrel.

11. An axle housing manufactured according to the method of claim 10.

* * * * *